United States Patent [19]

Asdollahi et al.

[11] 4,417,226

[45] Nov. 22, 1983

[54] ELECTRICAL FUSE

[75] Inventors: Norbert Asdollahi; Christian Gutzmer, both of Witten, Fed. Rep. of Germany

[73] Assignee: Wickmann-Werke GmbH, Witten-Annen, Fed. Rep. of Germany

[21] Appl. No.: 331,172

[22] Filed: Dec. 16, 1981

[30] Foreign Application Priority Data

May 13, 1981 [DE] Fed. Rep. of Germany ..... 3118943

[51] Int. Cl.[3] ..... H01H 85/38

[52] U.S. Cl. ..... 337/273; 337/279; 337/280

[58] Field of Search ..... 337/186, 197, 198, 199, 337/223, 163, 166, 248, 273, 279–282

[56] References Cited

U.S. PATENT DOCUMENTS 3,801,172 4/1974 Blewitt et al. ..... 337/280 X
4,100,523 7/1978 Arikawa et al. ..... 337/163
4,124,836 11/1978 Wilks ..... 337/186
4,283,700 8/1981 Akiyama ..... 337/280 X
4,323,873 4/1982 Nounen et al. ..... 337/186

FOREIGN PATENT DOCUMENTS 430095 6/1935 United Kingdom ..... 337/280

*Primary Examiner*—George Harris
*Attorney, Agent, or Firm*—Robert E. Burns; Emmanuel J. Lobato; Bruce L. Adams

[57] ABSTRACT

A miniature fuse has a housing consisting of a plastics base (1), a plastics cap (2), and two conductors which pass through the base and are bridged across inside the cap by a fusible conductor (3). The interior of the fuse housing is fully or partially lined with a ceramic-based lining (5) to protect the plastics against thermal decomposition and to promote condensation of the fusible conductor which may be evaporated, upon blowing of the fuse, to reduce internal pressure in the housing and hence avoid separation of the cap from the base and exposure of conductive parts.

17 Claims, 3 Drawing Figures

ELECTRICAL FUSE

Figure 1:
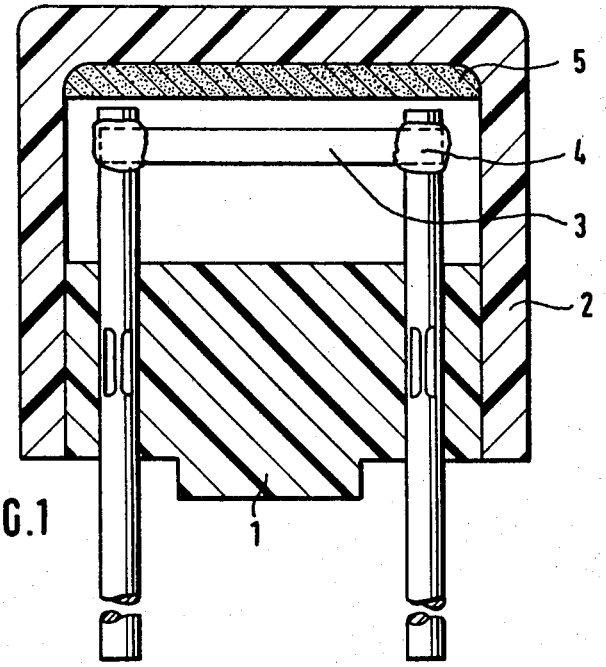

The invention relates to a subminiature electrical fuse comprising a housing formed by a plastics base and a plastics cap, and two conductors which pass through the base and are bridged across inside the housing by a fusible conductor. Such a fuse is hereinafter referred to as of the kind described.

A miniature fuse of this kind is known from, e.g. West German O/S No. 29 28 479. The base and cap are held together by a snap fit. Assembly is consequently particularly simple. Also the corresponding snap projections or grooves on the individual parts can be produced at low cost. Alternatively the connection may be a glued, welded or screw connection.

In such fuses, while, upon blowing of the fusible conductor by low and medium overcurrents no problems arise, at extremely high overcurrents, particularly with very thin fusible conductors, there may occur directly after the blowing a violent separation of the cap and base at a time when the overcurrent has not yet been cut off. As a result there exists the danger of the cap being loosened from the base and there existings for fractions of a second an open arc. Also, a fuse which after blowing is still under voltage and has lost its cap so that electrically conductive parts are exposed, forms a considerable danger.

The separation of the cap from the base may result from a number of causes. In some cases the explosion-like evaporation of the fusible conductor and the resulting rise in pressure inside the fuse housing is sufficient to bring about the separation. In other cases destruction of the plastics and the resulting development of gas contributes to the building up of an internal pressure sufficient for the separation. In that case something like the following process takes place: a powerful arc leads to a rise in temperature of the adjacent plastics up to a level at which the plastics, to put it simply, becomes decomposed into carbon and gaseous constituents. In this case the carbon, as a result of its electrically conductive property, favors the maintenance of the arc and this decomposition of the plastics and the development of gas is further promoted. The heating of the gas enclosed in the interior of the fuse housing leads additionally to a still further rise in pressure.

Attempts have already been made to deal with this phenomenon (West German O/S No. 30 33 529) by providing inside the fuse housing small brass plates, which because of their relatively high specific thermal capacity and good heat conductivity, are able to absorb part of the heat energy liberated at the time of the blowing of the fusible conductor. However, for reasons of insulation, the plates lie inside narrow cavities which allow the access of heat only from one side so that their heat absorbing action is poor. Furthermore the danger exists of the small plates becoming loose and then damaging the fusible conductor, which under certain circumstances is very sensitive, or bringing about a shunt or shortcircuit.

Consequently it is the object of the invention to create a miniature fuse of the kind described, the holding together of the housing parts of which is improved at extremely high overcurrents and in which unintentional damage to the fusible conductor is avoided.

According to the invention, this is achieved in that the interior of the housing surrounding the fusible conductor is wholly or partially lined with a ceramic-based insulating material.

The ceramic lining of the interior of the fuse housing is capable in many ways of assisting upon blowing of the fuse by an extremely high overcurrent. First of all, it fulfills the action known from the small metal plates of absorbing heat due to its additional inherent thermal capacity. Furthermore it has surprisingly proved to be an outstandingly good material for promoting and effecting the rapid condensation of the metal vapor which under certain circumstances arises at the time of the blowing, leading to a corresponding reduction in vapor volume and hence to a reduction of the internal pressure. The rapid condensation of the metal vapor furthermore extracts metallic ions from the internal atmosphere, whereby the conditions for the maintenance of an existing arc become drastically worsened. Finally the ceramic lining withstands the thermal loading for a certain time, whereby the surface temperature of the plastics is kept below the temperature of its decomposition, so that from this aspect no additional development of gas and increase in pressure can arise inside the fuse housing.

The lining may consist of a paper or web of ceramic fibres, but suspensions of aluminium oxide or silicon dioxide with water glass, or other organic or inorganic bonding medium, may serve equally well. The suspension may be pained or sprayed on or applied by dipping, whereas a ceramic paper or web is simply inserted in the interior of the housing.

In many cases the fusible conductor is arranged particularly close to the end of the cap remote from the base, so that the end is protected against the development of heat. In this case the lining of the end of the cap only is adequate for reliable operation of the fuse. Furthermore a cylindrical inner side face of the cap as well as the face of the base may be lined. This never does any harm, but, depending upon the position of the fusible conductor inside the interior of the fuse housing, is not always necessary.

Figure 2:
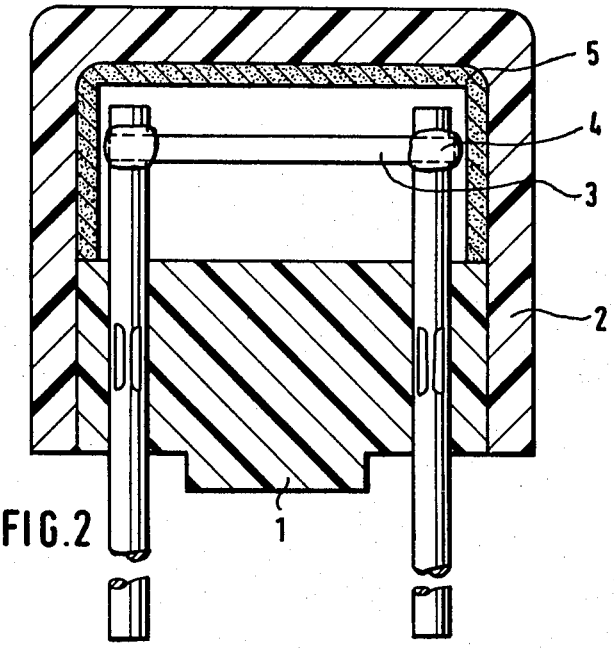
Figure 3:
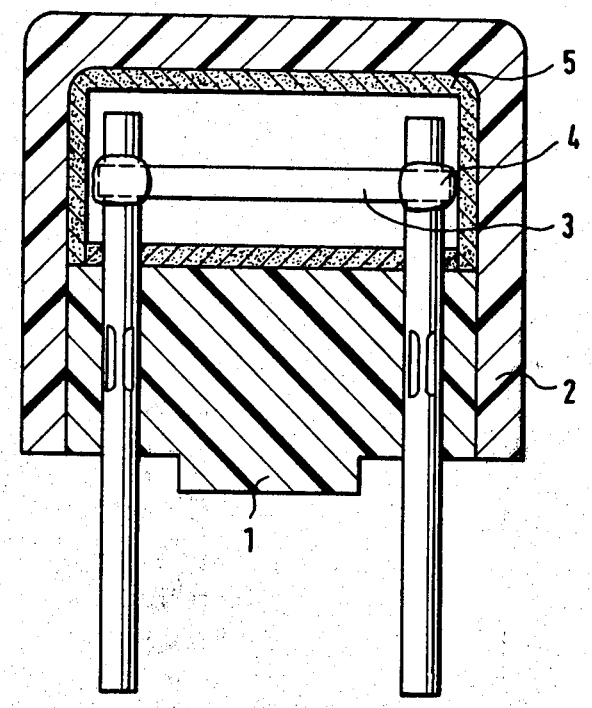

Some examples of fuses constructed in accordance with the invention are illustrated in the accompanying drawings, in which:

FIGS. 1 to 3 are similar sections through three different examples of fuse.

In each of FIGS. 1 to 3 a miniature fuse is illustrated which is lined in a different way. Each fuse consists essentially of a base 1 onto which a cap 2 is snapped. The fixing between the base 1 and the cap 2 is assured by projections running around the base and corresponding grooves inside the cap (not shown). In each case, two electrical conductors extend through the base 1 and are made as metal wires of circular cross-section. For the fixing of these wires inside the base 1, a section is deformed in the upper region by pinching, whereby a clamping action between each wire and the base 1 arises at this point. A fusible conductor 3 is attached to the ends of the two conductors, projecting above the base 1. It may be stretched freely as a bare wire essentially between the two conductors 2, if a high speed characteristic is required, or it may be formed into a helix if the miniature fuse is to have a slower characteristic. The attachment is usually effected by soldering.

The top end of the cap 2 in the FIG. 1 example is provided with a lining 5 of a ceramic paper or web. In this case the fusible conductor 3 is arranged particularly close to the top end of the cap 2, being soldered by means of solder 4 to the ends of the two conductors. A lining of only the end of the cap 2 is, for this special case, completely adequate, since the thermal loading of all of the remaining regions of the interior of the fuse housing is not so high as to require a lining in these other regions.

Various materials may be employed as the lining 5. What is important is only that they are heat-resistant and give off little gas under temperature loading. A ceramic-based material is particularly suitable. In that case both paper or fibres processed into a web may be employed, or ceramic powder such as $Al_2O_3$, $SiO_2$ or MgO supported in a binder.

In the case of the FIG. 1 example, a disc of ceramic paper has been employed, the disc having been obtained by punching out from an appropriate sheet. The disc is slightly larger in size, i.e. diameter, than the internal cross section, i.e. diameter, of the essentially cylindrical cap 2 so that by inserting it in the top of the cap, it remains in this position without any further assistance because of the force fit created by the slight jamming action. The ceramic paper may be further solidified by a ceramic hardener before or after punching out, whereby the lining 5 becomes still further capable of resisting the influence of temperature.

In FIG. 2 a further example of the invention is illustrated. Here the fusible conductor 3 is secured by means of solder 4 more in the center of the interior of the fuse housing, formed by the base 1 and the cap 2, The cylindrical inner walls too, insofar as they form the interior of the housing, are accordingly provided with the lining 5. In this case a suspension of, for example, an $Al_2O_3$ powder and water glass, is used as the lining 5. This paste which in the not yet hardened state is painted or sprayed on to the corresponding regions of the inside of the cap 2 or applied by means of a dip bath. After hardening, the lining 5 forms almost a cup which completely screens the cap 2 from the inside. It is in this case unimportant whether this cup-like lining adheres to the cap 2 or not, since in the assembled state the position of this lining is clearly fixed. The screening of the base 1 too is consequently not absolutely necessary because this is made considerably thicker than the cap it therefore needs a considerably longer action of temperature upon the base 1 until it is subjected to thermal decomposition and a resulting undesirable development of gas.

In order to avoid disadvantageous thermal action upon the fuse, the inside of the base 1 may obviously also be lined as shown in FIG. 3. The lining 5 may be achieved, in a simple way, by inserting a disc of ceramic paper on the corresponding top face of the base 1, and this should be effected before the soldering of the fusible conductor 3. As a rule, the two conductors carrying the fusible conductor 3 are thin and thereby sharp enough to pierce the disc punched out of ceramic paper at the two corresponding points upon laying it on the base, so that no special sharpening of these two conductors is needed during manufacture. With a lining 5 of ceramic paper on the base 1, a cap 2 may be attached the lining of which has been effected by the application of a suspension. Thus a ceramic paper or web may readily be combined with a ceramic suspension as the total lining. As the carrier material for the ceramic powder within the suspension, besides water glass, any other selfhardening binder may also be employed, e.g. organic or inorganic glues.

By means of a lining in accordance with the invention, the snap connection (not shown) between the cap 2 and the base 1 is reliably prevented from loosening in the event of the fuse blowing. Even if a separation between the cap and base were made more difficult, for example, by the application of a glue or by a screw connection, destruction of the cap would have to be expected without the lining in accordance with the invention and the electrically conductive parts would, as a result, be exposed in a dangerous manner. The formation of a very high internal pressure within the fuse housing, in combination with the high temperatures, leads, in the absence of the lining, first of all to the formation of cracks in the plastics, and, secondly, to peeling of whole regions of the fuse, so that, after the fuse has blown, a situation arises which is similar to that of the cap 2 being separated completely from the base 1.

We claim:

1. An electrical fuse comprising: a housing comprised of a plastic base, and a plastic cap connected to said base to define therewith the housing; two conductors extending through said base into the interior of said housing and being bridged across inside said housing by a fusible metal conductor; and a disc having a size which is slightly larger than the internal cross section of said cap and being inserted with a force fit into the interior of said cap to form a lining which at least partially lines the interior of said housing, the disc being composed of a ceramic-based insulating material effective to promote and effect the condensation thereon of metal vapor created by vaporization of the metal of the fusible metal conductor upon blowing of the fuse during an excessive overload thereby preventing explosive separation of said cap and base which could otherwise occur due to excessive pressure build up within the interior of said housing upon blowing of the fuse.

2. A fuse according to claim 1, wherein said lining consists of a paper or web of ceramic fibres.

3. A fuse according to claim 1, wherein said lining is provided only on surfaces of said cap.

4. A fuse according to claim 1, wherein said lining consists essentially of a ceramic-based insulated material.

5. A fuse according to claim 1, wherein said lining comprises a ceramic-based insulating material which is free of asbestos.

6. An electrical fuse comprising: a housing composed of plastic material and comprised of two connected together housing parts which define a housing interior having top, bottom and side surfaces; two electrical conductors extending through the housing and having ends projecting into the housing interior in spaced-apart relationship; a metal fusible conductor bridged across and electrically connected to the two spaced-apart conductors within the housing interior; and means including a lining of ceramic-based insulating material at least partially lining the housing interior surfaces and which remains intact upon blowing of the fuse for effectively promoting and effecting the condensation thereon of metal vapor created by vaporization of the metal of the fusible conductor upon blowing of the fuse during an excessive overload condition thereby preventing explosive rupture of the housing which could otherwise occur due to excessive pressure build up within the housing interior.

7. A fuse according to claim 6; wherein said lining consists of a paper or web of ceramic fibers.

8. A fuse according to claim 6; wherein said lining consists of a suspension in a bonding medium of a component selected from the group consisting of aluminium oxide, silicon oxide and magnesium oxide.

9. A fuse according to claim 8; wherein said bonding medium is water glass.

10. A fuse according to claim 6; wherein said lining consists essentially of a ceramic-based insulating material.

11. A fuse according to claim 6; wherein said lining comprises a ceramic-based insulating material which is free of asbestos.

12. A fuse according to claim 6; wherein said lining lines at least substantially the whole top interior surface of the housing.

13. A fuse according to claim 6; wherein said lining lines at least substantially the whole top and side interior surfaces of the housing.

14. A fuse according to claim 6; wherein said lining lines the top, bottom and side interior surfaces of the housing.

15. A fuse according to claim 6; wherein the two housing parts comprise a plastic base part through which extend the two electrical conductors, and a plastic cap part connected to the base part to define therewith the plastic housing; and wherein the lining comprises a disc inserted with a force fit into the interior of the cap part to line the top surface of the housing interior.

16. A fuse according to claim 15; wherein the disc comprises a paper or web of ceramic fibers.

17. A fuse according to claim 6; wherein the housing interior is free of any arc-quenching filler.

* * * * *